US009089220B2

(12) United States Patent
Weng

(10) Patent No.: US 9,089,220 B2
(45) Date of Patent: Jul. 28, 2015

(54) RECLINABLE CHAIR

(71) Applicant: Chi-San Weng, Chiayi County (TW)

(72) Inventor: Chi-San Weng, Chiayi County (TW)

( * ) Notice: Subject to any disclaimer, the term of this patent is extended or adjusted under 35 U.S.C. 154(b) by 0 days.

(21) Appl. No.: 14/331,659

(22) Filed: Jul. 15, 2014

(65) Prior Publication Data

US 2015/0035335 A1 Feb. 5, 2015

(30) Foreign Application Priority Data

Aug. 1, 2013 (TW) ..... 102127612 A

(51) Int. Cl.

| | |
|---|---|
| ***A47C 4/00*** | (2006.01) |
| ***A47C 7/54*** | (2006.01) |
| ***A47C 1/027*** | (2006.01) |
| *A47C 4/40* | (2006.01) |
| *A47C 1/035* | (2006.01) |
| *A47C 4/46* | (2006.01) |

(52) U.S. Cl.

CPC . *A47C 7/54* (2013.01); *A47C 1/027* (2013.01); *A47C 1/035* (2013.01); *A47C 4/40* (2013.01); *A47C 4/46* (2013.01)

(58) Field of Classification Search

CPC ..... A47C 1/035; A47C 4/46; A47C 4/40
USPC ..... 297/27, 28, 29, 354.12
See application file for complete search history.

(56) References Cited

U.S. PATENT DOCUMENTS

| | | | | |
|---|---|---|---|---|
| 2,099,460 | A * | 11/1937 | Bell | 297/365 |
| 2,571,463 | A * | 10/1951 | Lorenz | 297/29 |
| 6,692,068 | B1 * | 2/2004 | Tang | 297/16.2 |
| 7,500,715 | B1 * | 3/2009 | Chen | 297/27 |

* cited by examiner

*Primary Examiner* — Syed A Islam
(74) *Attorney, Agent, or Firm* — Muncy, Geissler, Olds & Lowe, P.C.

(57) ABSTRACT

A reclinable chair includes a seat frame, a backrest frame pivoted to the seat frame, and two armrest units, at least one of which includes a sleeve having a tubular body with an inner peripheral surface defining a passage, a core rod spaced from the inner peripheral surface by an annular gap and having a rear end pivoted to the backrest frame. A biasing member is disposed between a front end of the tubular body and a front end of the core rod. A positioning member is disposed in the sleeve, and includes two curved sections and an intermediate section. The positioning member is movable between loose and tight positions, where the intermediate section is not squeezed and is squeezed into the gap, respectively.

7 Claims, 11 Drawing Sheets

RECLINABLE CHAIR

CROSS-REFERENCE TO RELATED APPLICATION

This application claims priority of Taiwanese Application No. 102127612, filed on Aug. 1, 2013.

BACKGROUND OF THE INVENTION

1. Field of the Invention

The invention relates to a chair, and more particularly to a reclinable chair.

2. Description of the Related Art

Referring to FIGS. 1 and 2, a conventional reclinable chair is shown to comprise a seat frame 11, a front leg frame 12 and a rear leg frame 13 connected to the seat frame 11, a backrest frame 14 pivoted to a rear side of the seat frame 11, two spaced-apart armrests 15 connected pivotally and respectively to left and right sides of the backrest frame 14, and two adjustment seats 16 respectively disposed on bottom portions of the armrests 15. Each adjustment seat 16 includes a plurality of engaging teeth 161 spaced apart in a front-rear direction, and a plurality of positioning grooves 162 each defined by two adjacent ones of the engaging teeth 161. The front leg frame 12 includes two front leg rods 121 spaced apart in a left-right direction and extending downwardly, forwardly and inclinedly. The rear leg frame 13 includes two rear leg rods 131 spaced apart in the left-right direction and extending downwardly, rearwardly and inclinedly. Top ends of the rear leg rods 131 are respectively connected to top ends of the front leg rods 121. A junction 120 of each rear leg rod 131 and a respective front leg rod 121 is selectively engageable with one of the positioning grooves 162 in a corresponding adjustment seat 16. As such, the armrests 15 can be stably supported by the front and rear leg rods 121, 131.

To adjust a reclining angle of the backrest frame 14, each armrest 15 is first lifted upward slightly and is then pulled forward or pushed rearward to engage the junction 120 with a selected one of the positioning grooves 162 in the corresponding adjustment seat 16, thereby changing the position of each armrest 15 relative to the front and rear leg rods 121, 131. Because the armrests 15 are pivoted to the backrest frame 14, the reclining angle of the backrest frame 14 is simultaneously altered.

Although the conventional reclinable chair can achieve its intended purpose, the adjustment of the reclining angle of the backrest frame 14 thereof is complicated and inconvenient. Further, because the engaging teeth 161 of each adjustment seat 16 are exposed, injury to the user's hand is likely to occur during adjustment.

SUMMARY OF THE INVENTION

Therefore, the object of the present invention is to provide a reclinable chair that is easy to adjust a reclining angle thereof and that is safe to use.

Accordingly, a reclinable chair of the present invention comprises a seat frame, a backrest frame pivoted to a rear side of the seat frame, two armrest units, and a positioning member. At least one of the armrest units includes a sleeve, and a core rod that extends through the sleeve, that is movable in a front-rear direction relative to the sleeve and that has a rear end pivoted to the backrest frame. The sleeve includes a tubular body surrounding the core rod and having an inner peripheral surface that de fines a pas sage. The core rod extends through the passage and is spaced from the inner peripheral surface by an annular gap. The tubular body further has a through hole communicating with the passage. The at least one of the armrest units further includes a biasing member disposed between a front end of the tubular body and a front end of the core rod. The positioning member is disposed in the sleeve and includes an engaging portion disposed around the core rod and within the annular gap. The engaging portion includes two curved sections, and an intermediate section connected between the curved sections. The engaging portion has a thickness that increases gradually from the curved sections to the intermediate section. The intermediate section protrudes partially into the through hole. The curved sections extend from the intermediate section in two opposite directions away from the through hole into the annular gap. The intermediate section has a thickness larger than a width of the annular gap. The positioning member is movable between a loose position, where the intermediate section is not squeezed into the annular gap, and a tight position, where the intermediate section is squeezed tightly into the annular gap to thereby restrict movement of the core rod relative to the tubular body. When the backrest frame is reclined to pivot rearward relative to the seat frame, the core rod of the at least one of the armrest units is driven to move rearward relative to the tubular body so that the biasing member is compressed to store a restoring force which biases the backrest frame to pivot forward, thereby stabilizing the backrest frame at a reclining angle.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
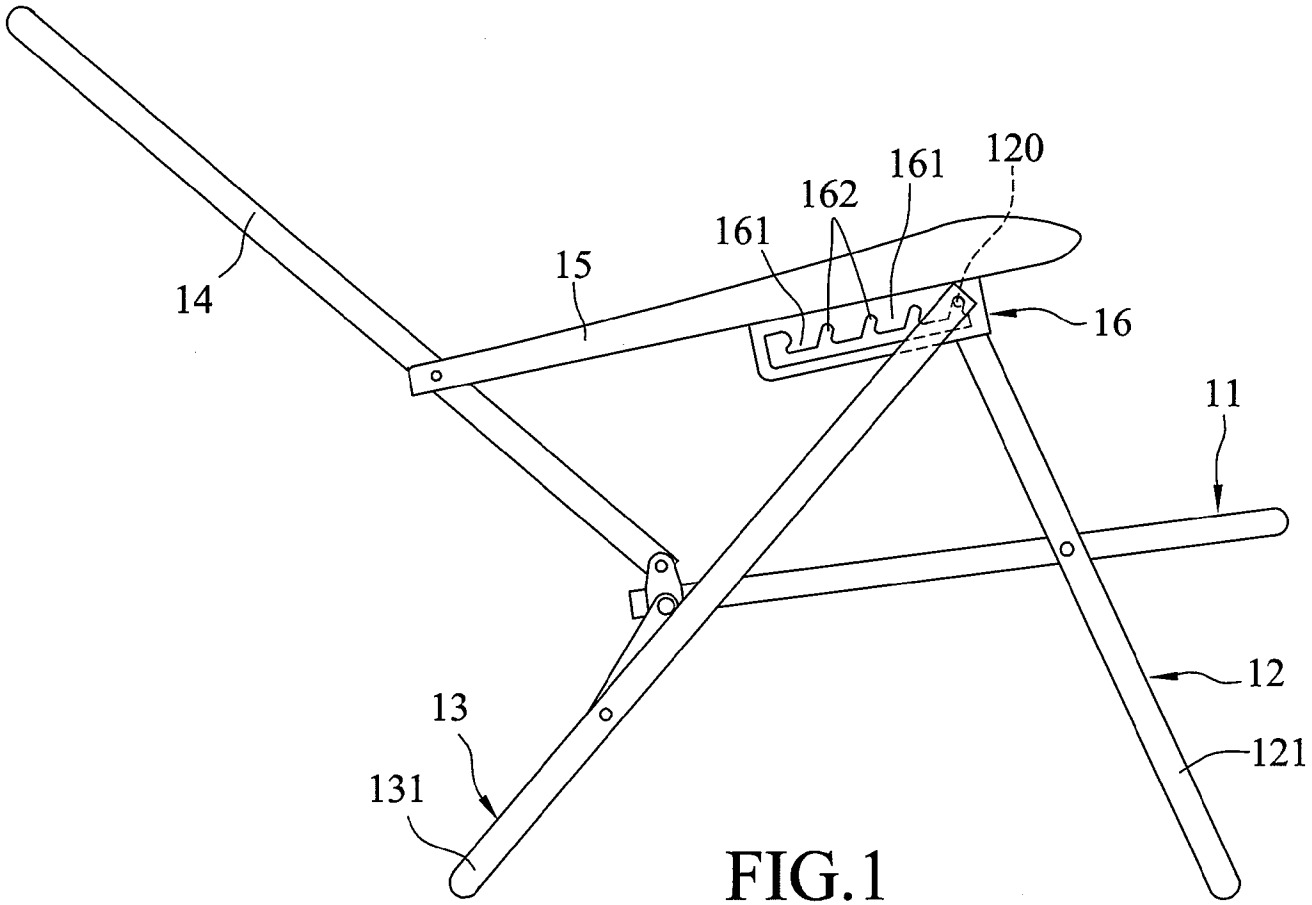
FIG.1 PRIOR ART
FIG. 1 is a schematic side view of a conventional reclinable chair.
Figure 2:
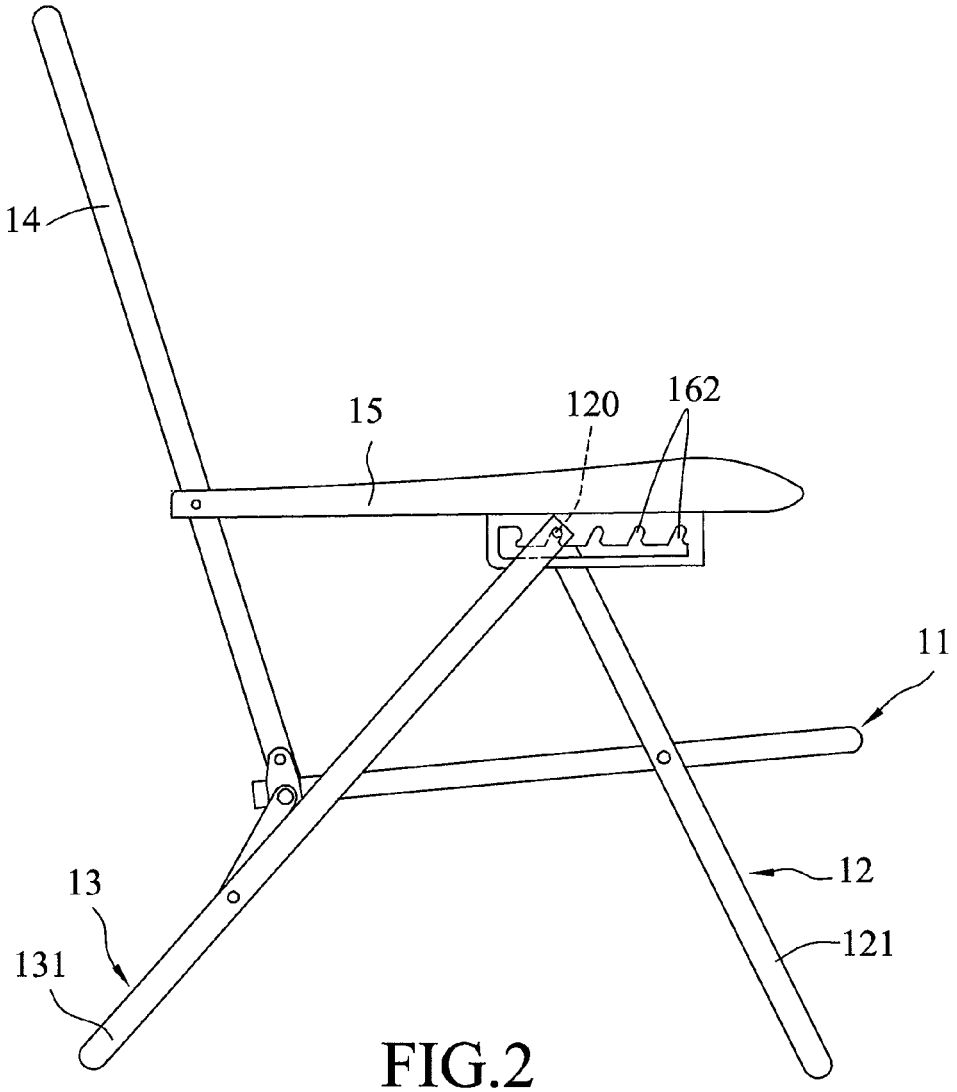
FIG.2 PRIOR ART
FIG. 2 is a view similar to FIG. 1, but with a backrest frame having a different reclining angle.
Figure 3:
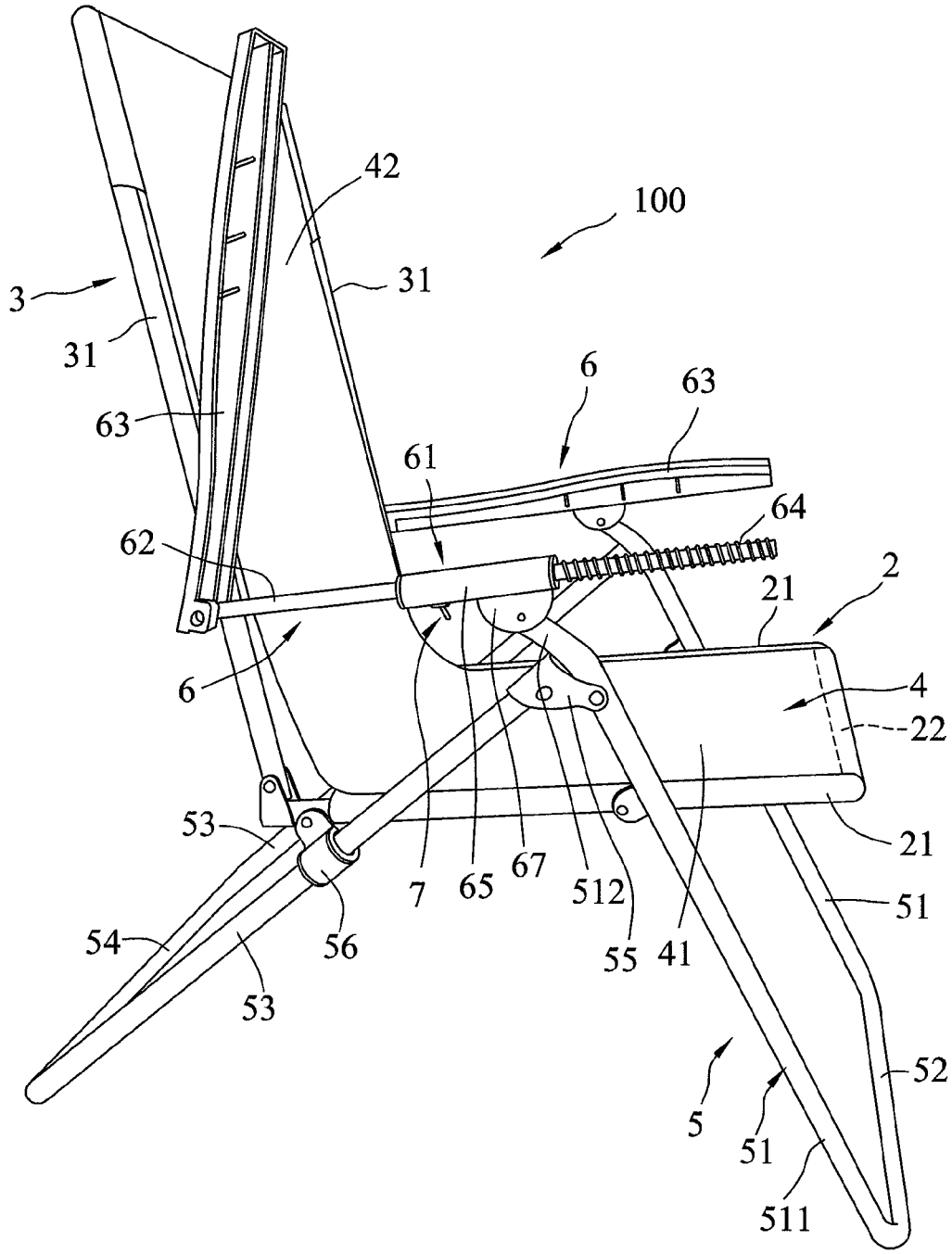
FIG. 3 is a perspective view of a reclinable chair according to the preferred embodiment of the present invention.

Referring to FIGS. 3 to 8, a chair 100 according to the preferred embodiment of the present invention comprises a seat frame 2, a backrest frame 3, a chair cushion 4, a leg frame 5, two armrest units 6, and a positioning member 7.

The seat frame 2 includes two seat side rods 21 spaced apart in a left-right direction and extending in a front-rear direction, and a seat cross rod 22 (shown in phantom lines)

connected between front ends of the seat side rods 21 and extending in the left-right direction.

The backrest frame 3 is pivoted adjustably to a rear side of the seat frame 2, and includes two backrest side rods 31 spaced apart in the left-right direction and extending in a top-bottom direction, and a backrest cross rod (not shown) connected between the backrest side rods 31 and extending in the left-right direction. The backrest side rods 31 have bottom ends respectively pivoted to rear ends of the seat side rods 21.

The chair cushion 4 is a single cushion body that includes a seat cushion 41 connected to the seat frame 2 and a backrest cushion 42 connected to the backrest frame 3 to provide comfort sitting and reclining by a user.

The leg frame 5 includes two first leg rods 51 respectively connected to the seat side rods 21, a first bottom cross rod 52 connected between bottom ends of the first leg rods 51 and extending in the left-right direction, two second leg rods 53 respectively connected to the seat side rods 21 spaced apart from the first leg rods 51, and a second bottom cross rod 54 connected between bottom ends of the second leg rods 53 and extending in the left-right direction.

Each first leg rod 51 includes a main rod section 511 extending upwardly, rearwardly and inclinedly from one end of the first bottom cross rod 52, and an inclined rod section 512 extending upwardly, rearwardly and inclinedly from a top end of the main rod section 511. A top end of each second leg rod 53 extends into a pivot-connecting member 55 so as to be pivoted with the main rod section 511 of a respective first leg rod 51 in proximity to the inclined rod section 512. A junction of the second leg rod 53 and the respective first leg rod 51 is located higher than the seat frame 2. Each second leg rod 53 extends through a pivot-connecting member 56 so as to be pivoted with a respective seat side rod 21 in proximity to the rear end thereof.

The armrest units 6 are respectively connected to left and right sides of the backrest frame 3 and extend forwardly therefrom to connect with the leg frame 5. Each armrest unit 6 includes a sleeve 61 connected to a corresponding first leg rod 51, a core rod 62 extending through and movable in the sleeve 61 in the front-rear direction, an armrest member 63 mounted on and movable along with the core rod 62, and a biasing member 64 sleeved on the core rod 62.

The sleeve 61 includes a tubular body 65 surrounding the core rod 62, two end caps 66 respectively connected to front and rear ends of the tubular body 65, and a connecting member 67 fixed to a bottom side of the tubular body 65. The tubular body 65 has an inner peripheral surface 651 defining a passage 652. The connecting member 67 is connected to the inclined rod section 512 of the corresponding first leg rod 51. The tubular body 65 of the sleeve 61 of one of the armrest units 6 further has a through hole 653 formed in the bottom side thereof and communicating with the passage 652.

Each end cap 66 includes an annular insert portion 661 inserted into the respective front or rear end of the tubular body 65, an annular flange 662 extending outwardly, integrally and radially from an outer end of the insert portion 661 and located externally of the tubular body 65, and an insert hole 663 formed in the insert portion 661 and communicating with the passage 652. The insert hole 663 has a diameter approximately equal to that of the core rod 62 but smaller than a diameter of the passage 652. Through this, the core rod 62 can extend through the end caps 66 and the passage 652, and contact walls that define the respective insert holes 663 in the insert portions 661 of the end caps 66. The core rod 62 is spaced from the inner peripheral surface 651 of the tubular body 65 by an annular gap 60. The annular gap 60 has a width (w) which is the distance between the core rod 62 and the inner peripheral surface 651.

A rear end of the core rod 62 and a rear end of the armrest member 63 of each armrest unit 6 are pivoted to the corresponding backrest side rod 31. The armrest member 63 covers the sleeve 61, the core rod 62 and the biasing member 64, and is liftable relative to the core rod 62 with the rear end of the armrest member 63 serving as a fulcrum. A front end of the armrest member 63 is provided with a stop portion 631 that abuts against the front end of the core rod 62. The biasing member 64 is a compression spring having two opposite ends respectively abutting against the front end of the tubular body 65 and the stop portion 631. That is, the biasing member 64 is limited between the front end of the tubular body 65 and the front end of the core rod 62.

Figure 4:
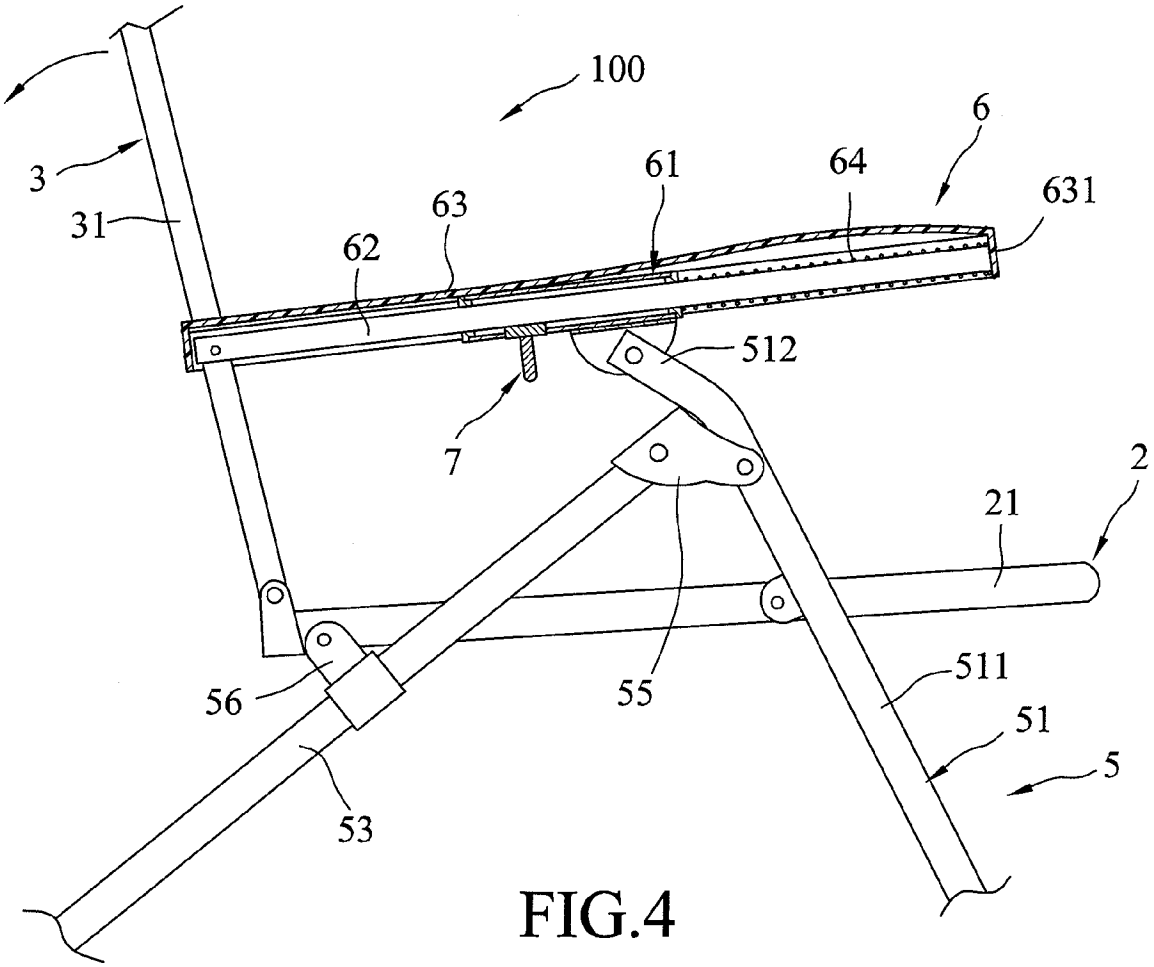
FIG. 4 is a fragmentary schematic side view of the preferred embodiment.
Figure 5:
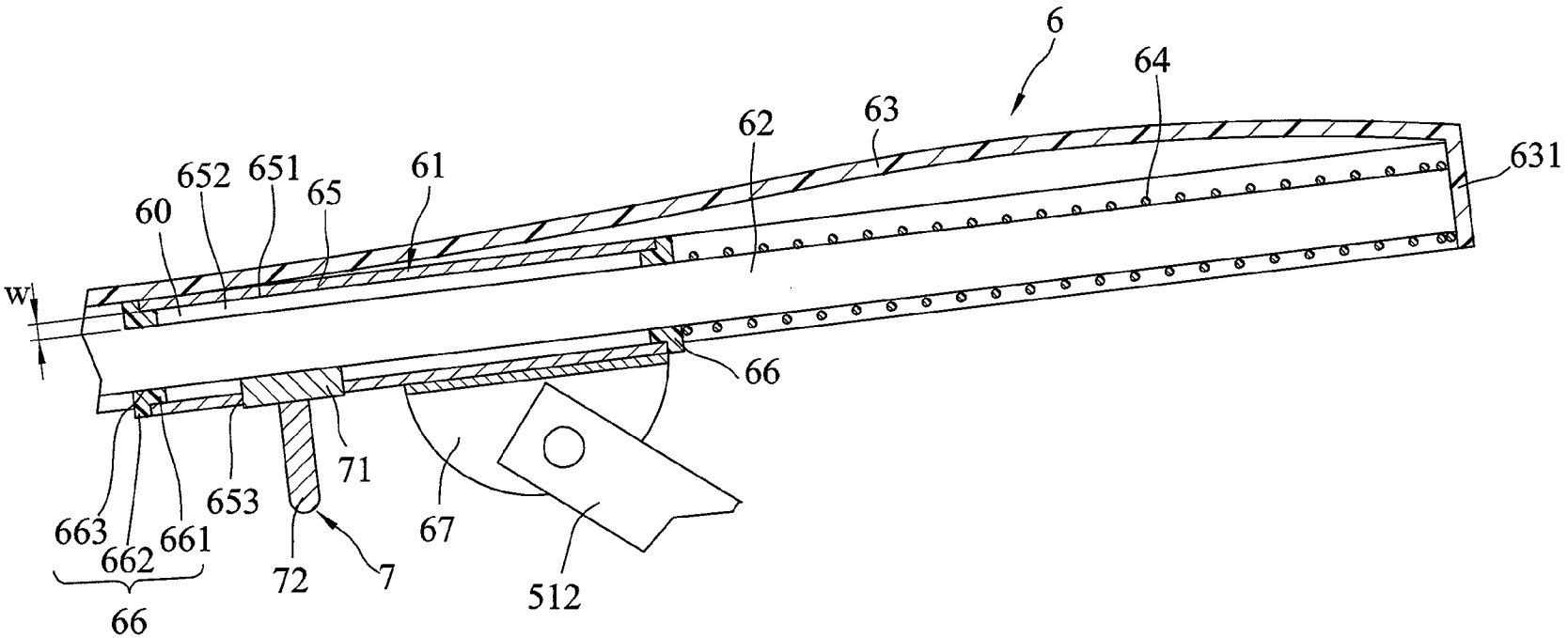
FIG. 5 is a fragmentary enlarged sectional view of FIG. 4.
Figure 6:
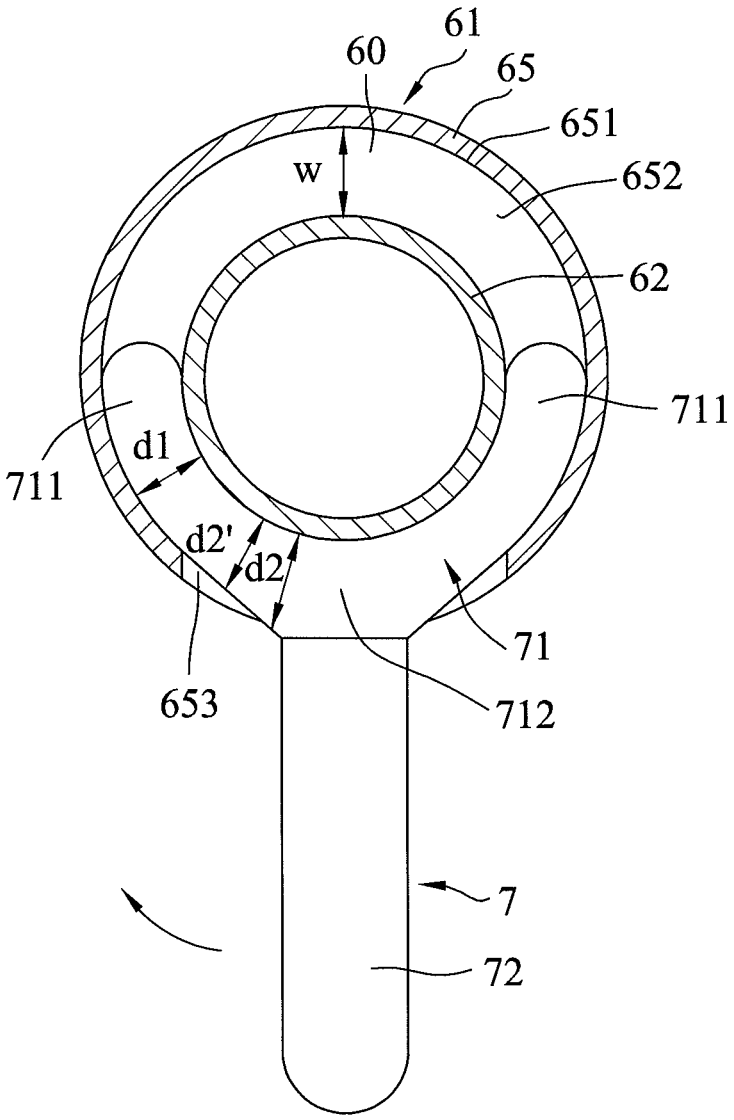
FIG. 6 is a sectional view of a portion of the preferred embodiment, illustrating a positioning member in a loose position.

With reference to FIGS. 4 to 6, the positioning member 7 is disposed in the tubular body 65 of the sleeve 61 of the one of the armrest units 6, and includes an engaging portion 71 disposed around the core rod 62 and within the annular gap 60, and an operating portion 72 connected to the engaging portion 71 and extending externally of the tubular body 65. The engaging portion 71 includes two curved sections 711 respectively disposed on left and right sides of the core rod 62, and an intermediate section 712 connected between the curved sections 711. The intermediate section 712 protrudes partially into the through hole 653. The curved sections 711 extend from the intermediate section 712 in two opposite directions away from the through hole 653 into the annular gap 60. The intermediate section 712 has a thickness (d2) larger than a thickness (d1) of each curved section 711. The thickness (d1, d2) of each of the curved and intermediate sections 711, 712 refers to the thickness of each curved or intermediate section 711, 712 along a radial direction of the core rod 62. The thickness (d1) of each curved section 711 is equal to or slightly smaller than the width (w) of the gap 60, while the thickness (d2) of the intermediate section 712 is larger than the width (w) of the gap 60. It should be noted that the engaging portion 71 has a thickness that increases gradually from the curved sections 711 to the intermediate section 712, so that the thickness of the intermediate section 712 at different positions is not uniform. That is, the thickness (d2) is different from the thickness (d2'), but is all larger than the width (w) of the gap 60. The operating portion 72 is an elongated stem, and is operable to drive movement of the engaging portion 71 around the core rod 62.

Alternatively, the operating portion 72 and the engaging portion 71 may be two separate independent components. In this case, the engaging portion 71 may be provided with a threaded hole, while the operating portion 72 may be provided with an external thread to engage the threaded hole. During assembly, the engaging portion 71 is first inserted into the passage 652 via the front or rear end of the tubular body 65, and is moved to a position corresponding to that of the through hole 653. The operating portion 72 is then threadedly engaged with the engaging portion 71.

Figure 7:
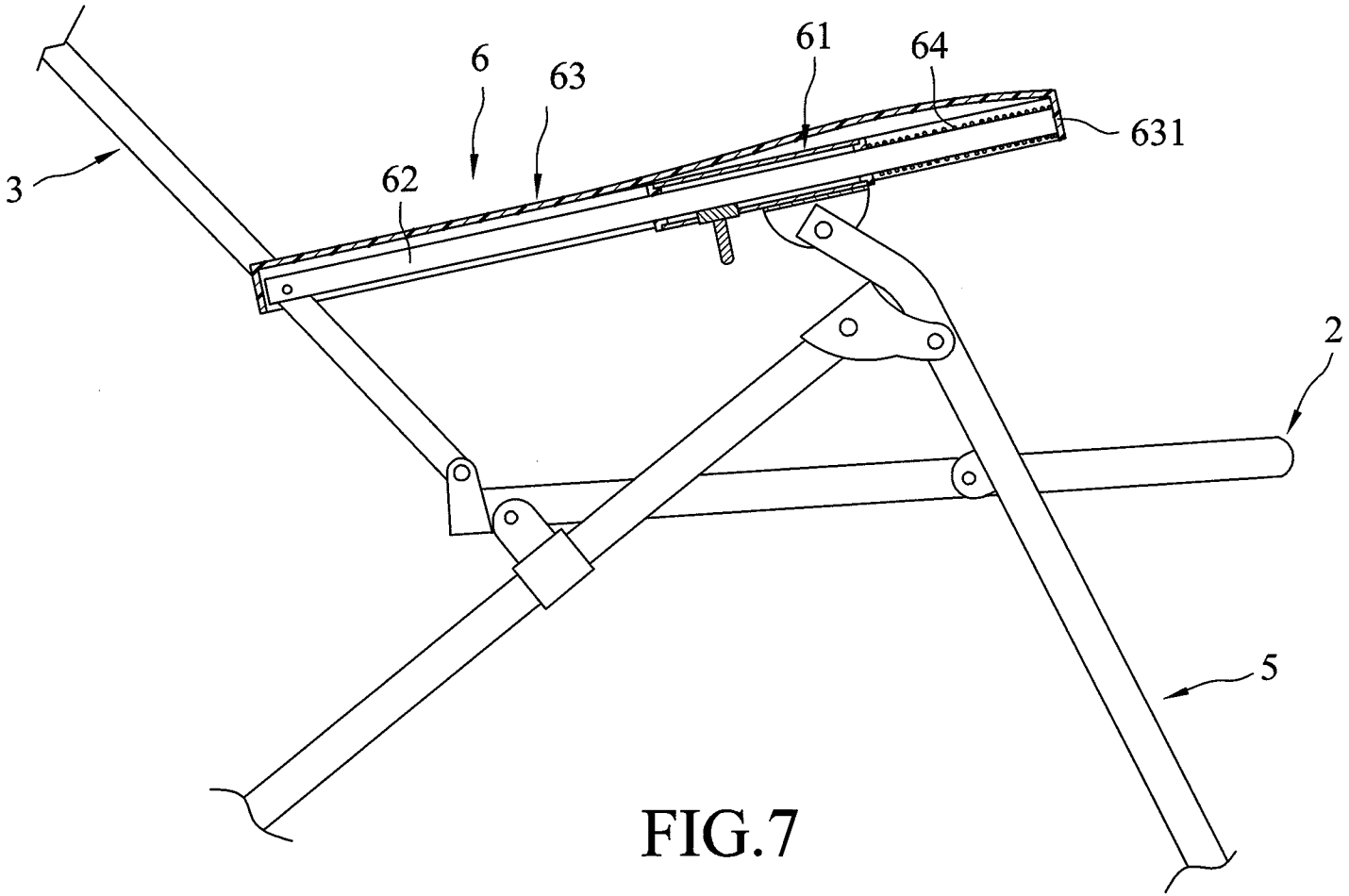
FIG. 7 is a view similar to FIG. 4, but illustrating a backrest frame in a different reclining angle.

With reference to FIGS. 4, 5 and 7, to adjust a reclining angle of the backrest frame 3 during use of the chair 100, a user reclines with force on the backrest cushion 42 so as to move the backrest frame 3 in the direction of an arrow shown in FIG. 4. The backrest frame 3 pivots rearward about a junction of the bottom ends of the backrest side rods 31 and the rear ends of the respective seat side rods 21, and drives the core rod 62 and the armrest member 63 of each armrest unit 6 to move rearwardly therealong. At this time, the biasing member 64 is compressed between the stop portion 631 and the front end of the tubular body 65 to store a restoring force that biases the backrest frame 3 to pivot forward. The restoring force is balance with the reclining force exerted by the user on the backrest frame 3 so as to stabilize the backrest frame 3 at a reclining angle arbitrarily. Concretely speaking, if the reclining angle of the backrest frame 3 is large, an amount of rearward displacements of the core rod 62 and the armrest member 63 of each armrest unit 6 is large, and the restoring force generated by the biasing member 64 is also large. If the reclining angle of the backrest frame 3 is small, the amount of the rearward displacements of the core rod 62 and the armrest member 63 of each armrest unit 6 is small, and the restoring force generated by the biasing member 64 is also small.

If the user desires to recline from a position having a large reclined angle, as shown in FIG. 7, to a position having a small reclined angle, as shown in FIG. 4, the user moves his/her body slightly forward away from the backrest frame 3 so as to release the stored restoring force of the biasing member 64. As such, the restoring force of the biasing member 64 can push forward the stop portion 631 of the armrest member 63 of each armrest unit 6 so as to pull the core rod 62 and the armrest member 63 of each armrest unit 6 as well as the backrest frame 3 to move forward therealong, so that the reclining angle of the backrest frame 3 becomes small.

Further, because the weight of a user is different, force exerted by the user to recline is also different. To meet this demand, the chair 100 of this invention may select and use a biasing member having a variety of different spring constants (k). When the amount of compression is similar, the biasing member with large spring constant (k) can bear a large external force, so that it is suitable for use when the user has a heavy weight. Moreover, the chair 100 of this invention only needs one of the armrest units 6 be provided with the biasing member 64 to stabilize the reclining angle. Hence, it is not necessary to provide the biasing member 64 on each of the two armrest units 6.

It should be noted that the first leg rod 51 is not designed wholly as a straight line because, although the sleeve 61 of each armrest unit 6 is connected to the corresponding first leg rod 51, if each first leg rod 51 extends in a straight line, the sleeve 61 will be in a more forward position. In contrast, because the first leg rod 51 of this invention has the inclined rod section 512 which is inclined rearward, the sleeve 61 will be in a more rearward position. Thus, the distance between the front end of the tubular body 65 and the stop portion 631 of the armrest member 63 can be prolonged, so that the core rod 62 and the armrest member 63 can move rearward by a long distance. The biasing member 64 may be lengthened accordingly to thereby increase a rearward pivoting angle of the backrest frame 3.

Figure 8:
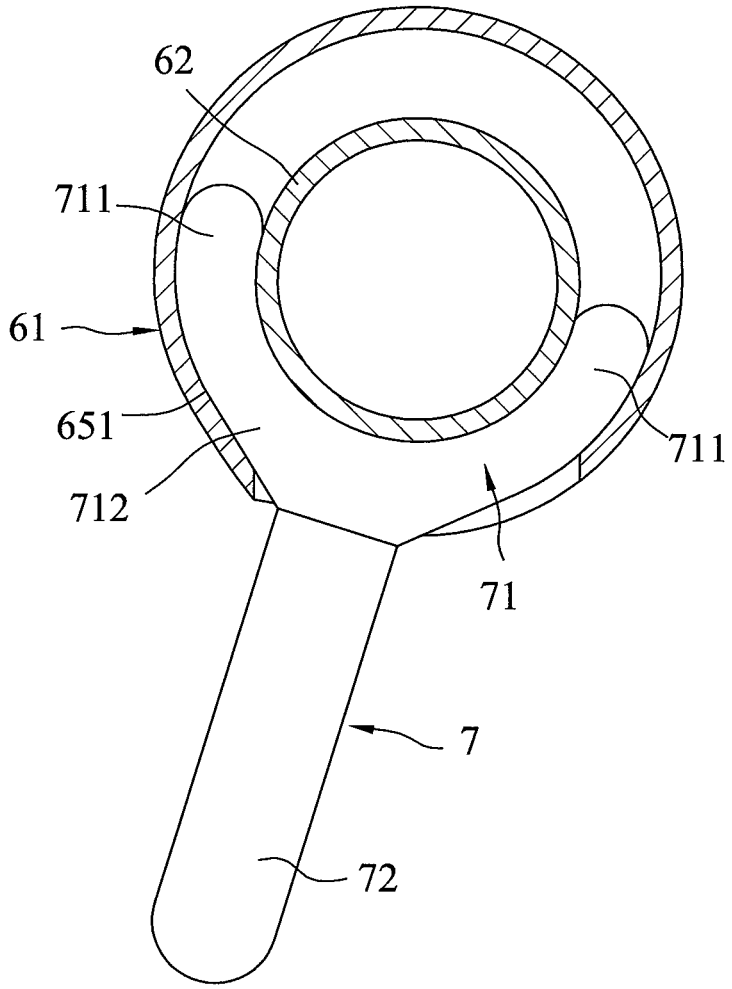
FIG. 8 is a view similar to FIG. 6, but illustrating the positioning member in a tight position.

With reference to FIGS. 4, 6 and 8, the positioning member 7 is movable between a loose position, as shown in FIG. 6, and a tight position, as shown in FIG. 8. In the loose position, the intermediate section 712 is not squeezed into the annular gap 60. Further, the operating portion 72 extends substantially vertically downward. At this time, although the core rod 62 is in contact with the curved sections 711, it is not in tight contact with the same, so that the core rod 62 is freely movable forward and rearward relative to the tubular body 65 of the sleeve 61. When the operating portion 72 is operated to move in the direction of an arrow, as shown in FIG. 6 (or in a direction opposite to the arrow), the engaging portion 71 is driven to rotate, thereby shifting the positioning member 7 to the tight position. In the tight position, the intermediate section 712 is squeezed tightly into the annular gap 60 between the tubular body 65 and the core rod 62, thereby restricting movement of the core rod 62 relative to the tubular body 65 of the sleeve 61.

Through the configuration of the positioning member 7, the user can freely adjust the angle of the backrest frame 3 when the positioning member 7 is in the loose position. After the angle is adjusted, the operating portion 72 is operated to shift the positioning member 7 to the tight position so as to restrict movement of the core rod 62, thereby fixing the position of the backrest frame 3 in the adjusted angle. Hence, the positioning member 7 is safe to use. Since the biasing member 64 can be used to stabilize the backrest frame 3 at a reclining angle arbitrarily, the positioning member 7 is not a necessity. When not in use, the chair 100 of this invention can be folded to facilitate the storage thereof.

In summary, through the configuration of the armrest units 6, the user can simply recline on the backrest cushion 42 to drive the backrest frame 3 to pivot backward and position thereat, and when the user moves forward, the restoring force of the biasing member 64 can bias the backrest frame 3 to pivot forward so as to reduce the reclining angle of the backrest frame 3. Hence, use of the chair 100 of this invention is very convenient. Further, because there is no need to adjust the reclining angle of the backrest frame 3 by hand, injury to the user's hand can be avoided, so that the chair 100 of this invention is safe to use.

Figure 9:
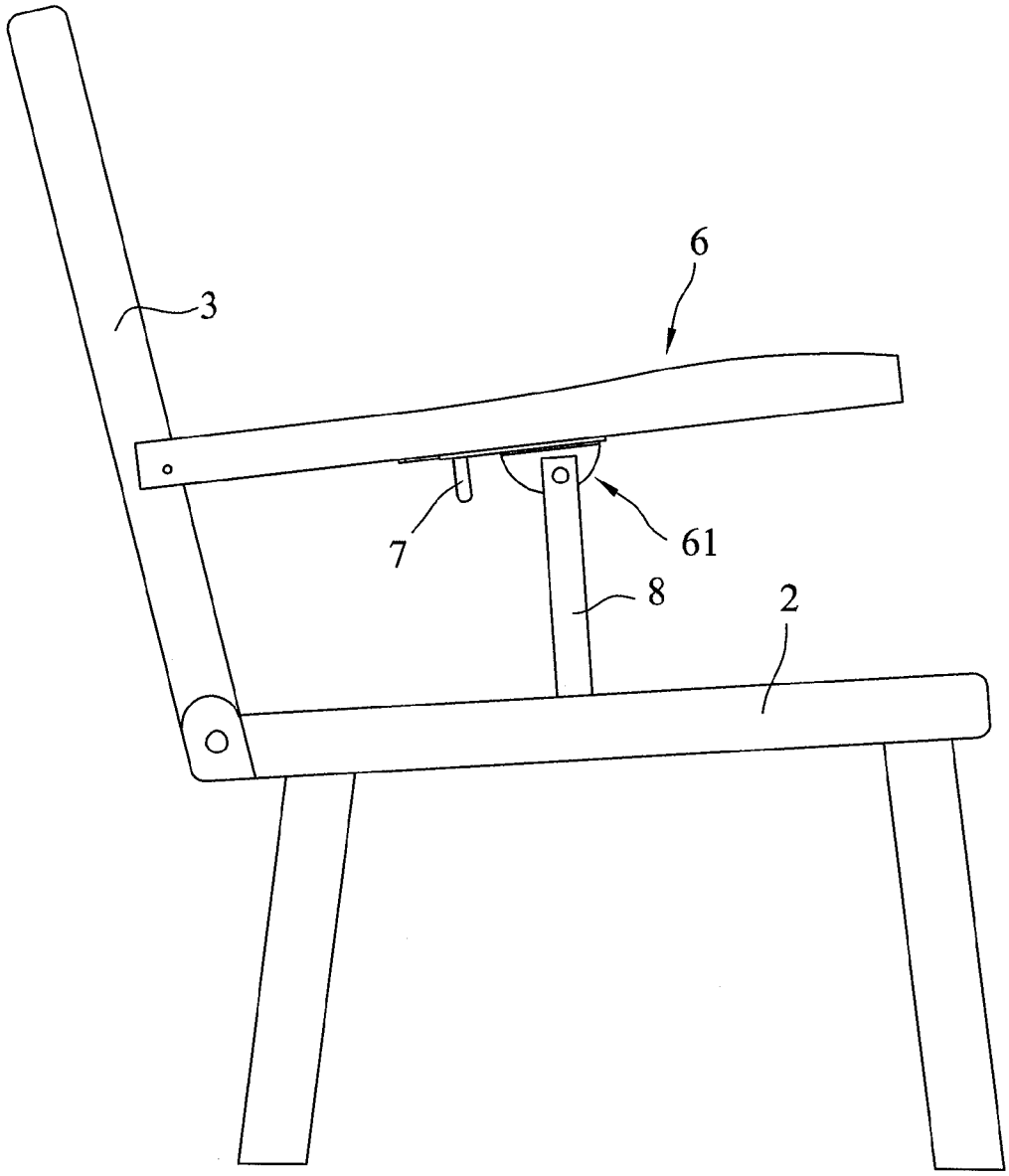
FIG. 9 is a schematic side view of another implementation of the chair of this invention.
Figure 10:
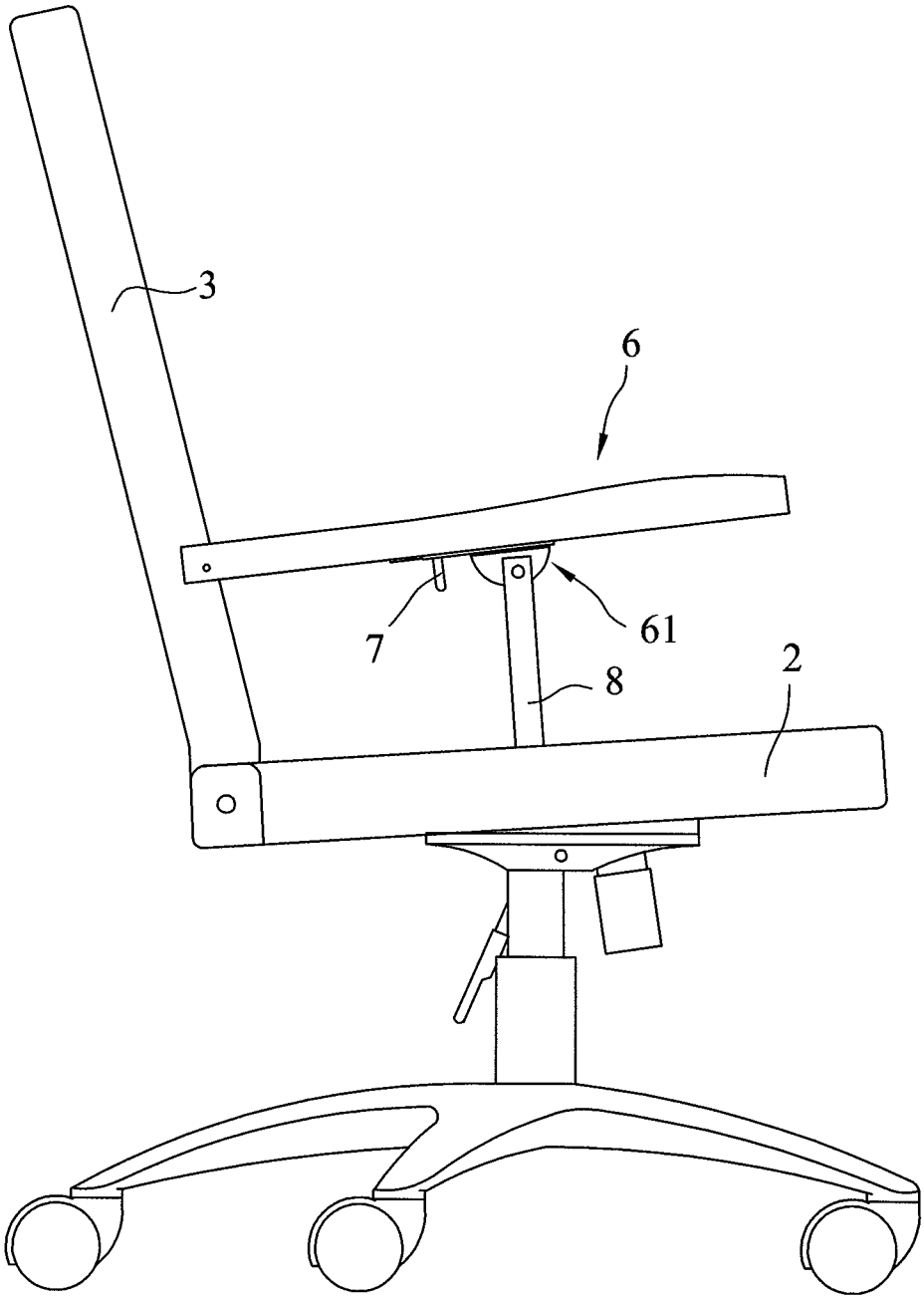
FIG. 10 is a schematic side view of yet another implementation of the chair of this invention.
Figure 11:
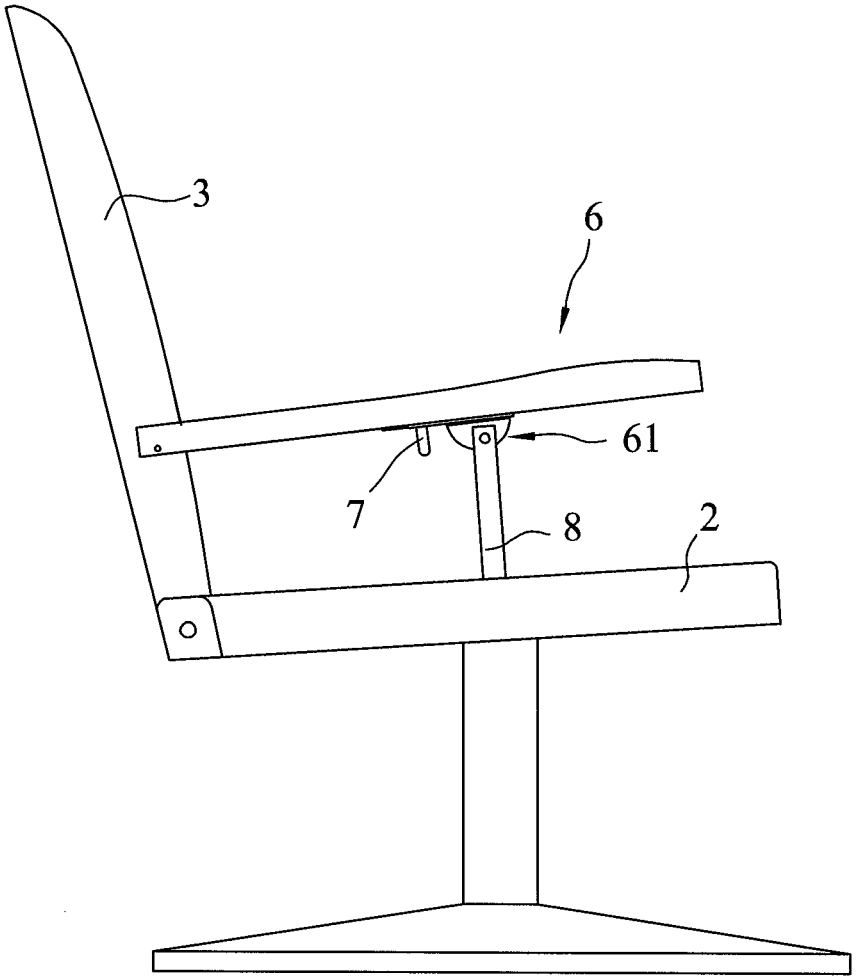
FIG. 11 is a schematic side view of still another implementation of the chair of this invention.

The automatic adjustment of the reclining angle of the backrest frame 3 and the use of the positioning member 7 to position the backrest frame 3 are not limited to being applied on the aforesaid structure and type of the chair. They may be implemented on a domestic chair (see FIG. 9), an office chair (see FIG. 10), or a salon chair (see FIG. 11). As shown in FIG. 9, the domestic chair has two upright supports 8 (only one is shown) respectively located on left and right sides of the seat frame 2. The sleeves 61 of the armrest units 6 are respectively fixed on the upright supports 8. As shown in FIG. 10, the sleeves 61 of the armrest units 6 are similarly and respectively fixed on the upright supports 8 of the office chair.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A reclinable chair comprising:

a seat frame;

a backrest frame pivoted to a rear side of said seat frame;

two armrest units, at least one of which includes a sleeve, and a core rod that extends through said sleeve, that is movable in a front-rear direction relative to said sleeve and that has a rear end pivoted to said backrest frame, said sleeve including a tubular body surrounding said core rod and having an inner peripheral surface that defines a passage, said core rod extending through said passage and being spaced from said inner peripheral surface by an annular gap, said tubular body further having a through hole communicating with said passage, said at least one of said armrest units further including a biasing member disposed between a front end of said tubular body and a front end of said core rod; and a positioning member disposed in said sleeve and including an engaging portion disposed around said core rod and within said annular gap, said engaging portion including two curved sections, and an intermediate section connected between said curved sections, said engaging portion having a thickness that increases gradually from said curved sections to said intermediate section, said intermediate section protruding partially into said through hole, said curved sections extending from said intermediate section in two opposite directions away from said through hole into said annular gap, said intermediate section having a thickness larger than a width of said annular gap, said positioning member being movable between a loose position, where said intermediate section is not squeezed into said annular gap, and a tight position, where said intermediate section is squeezed tightly into said annular gap to thereby restrict movement of said core rod relative to said tubular body;

wherein, when said backrest frame is reclined to pivot rearward relative to said seat frame, said core rod of said at least one of said armrest units is driven to move rearward relative to said tubular body so that said biasing member is compressed to store a restoring force which biases said backrest frame to pivot forward, thereby stabilizing said backrest frame at a reclining angle.

2. The reclinable chair as claimed in claim 1, wherein said armrest units both include said sleeve, said core rod and said biasing member.

3. The reclinable chair as claimed in claim 2, further comprising a leg frame, said leg frame including two first leg rods respectively located on left and right sides of said seat frame and respectively connected to said sleeves of said armrest units, and a first bottom cross rod connected between said first leg rods, each of said first leg rods including a main rod section extending upwardly, rearwardly and inclinedly from one end of said first bottom cross rod, and an inclined rod section extending upwardly, rearwardly and inclinedly from a top end of said main rod section and connected to said sleeve of a corresponding one of said armrest units.

4. The reclinable chair as claimed in claim 2, wherein each of said armrest units further includes an armrest member covering said sleeve, said core rod and said biasing member, said armrest member having a rear end pivoted to said backrest frame, and a front end provided with a stop portion, said armrest member being movable along with said core rod, said biasing member being sleeved on said core rod and being limited between said front end of said tubular body and said stop portion.

5. The reclinable chair as claimed in claim 1, wherein said positioning member further includes an operating portion connected to said engaging portion and extending externally of said tubular body, said operating portion being operable to drive movement of said engaging portion around said core rod.

6. The reclinable chair as claimed in claim 1, wherein said sleeve further includes two end caps respectively connected to front and rear ends of said tubular body, each of said end caps including an insert hole communicating with said passage and having a diameter smaller than that of said passage, said core rod extending through said insert holes in said end caps and said passage in said tubular body.

7. The reclinable chair as claimed in claim 1, wherein said seat frame includes two seat side rods spaced apart in a left-right direction and extending in a front-rear direction, said backrest frame including two backrest side rods spaced apart in the left-right direction and extending in a top-bottom direction, said backrest side rods having bottom ends respectively pivoted to said seat side rods, said core rods of said armrest units being respectively pivoted to said backrest side rods.

* * * * *